US009221188B1

(12) United States Patent
Wisen

(10) Patent No.: US 9,221,188 B1
(45) Date of Patent: Dec. 29, 2015

(54) PRECISION POSITIONING OF A FENCE

(76) Inventor: Dennis R. Wisen, Painesville, OH (US)

( * ) Notice: Subject to any disclaimer, the term of this patent is extended or adjusted under 35 U.S.C. 154(b) by 1120 days.

(21) Appl. No.: 13/253,125

(22) Filed: Oct. 5, 2011

Related U.S. Application Data

(60) Provisional application No. 61/390,777, filed on Oct. 7, 2010.

(51) Int. Cl.
*B27C 5/04* (2006.01)

(52) U.S. Cl.
CPC ..... *B27C 5/04* (2013.01)

(58) Field of Classification Search
CPC ..... B23D 33/10; B23Q 16/001; B23Q 17/22; B23Q 3/005; B23Q 3/007; B27B 27/02; B27B 27/10; B27C 5/04; Y10T 409/308624
USPC ..... 269/291, 303; 144/253.1; 33/628; 409/218; 83/446
See application file for complete search history.

(56) References Cited

U.S. PATENT DOCUMENTS 1,963,688 A * 6/1934 Tautz ..... 83/438
2,325,082 A * 7/1943 Tautz ..... 83/438
2,556,548 A * 6/1951 Modderman ..... 83/438
2,562,246 A * 7/1951 Van Dam et al. ..... 83/438
2,677,400 A * 5/1954 Gaskell ..... 83/438
2,740,437 A * 4/1956 Odlum et al. ..... 83/438
2,744,549 A * 5/1956 Johnson ..... 83/438
2,771,103 A * 11/1956 Odlum et al. ..... 83/438
2,919,729 A * 1/1960 Edgemond, Jr. et al. ..... 83/438
2,966,179 A * 12/1960 Gaskell ..... 83/438
3,011,531 A * 12/1961 Gaskell ..... 83/438
3,240,244 A * 3/1966 Biro ..... 83/421
4,322,066 A * 3/1982 Disney ..... 269/304
4,635,515 A * 1/1987 Altman ..... 83/438
4,793,604 A * 12/1988 Taylor ..... 269/303
5,186,226 A 2/1993 Wang
5,195,730 A * 3/1993 Taylor ..... 269/303
5,215,296 A * 6/1993 Adams et al. ..... 269/60
5,305,812 A * 4/1994 Ferencsik ..... 144/356
5,396,937 A * 3/1995 Clausen ..... 144/135.2
5,460,070 A * 10/1995 Buskness ..... 83/438
5,524,514 A * 6/1996 Hadaway et al. ..... 83/76.9
5,553,644 A * 9/1996 Adams ..... 144/253.2
5,722,308 A * 3/1998 Ceroll et al. ..... 83/438
5,740,711 A * 4/1998 Ramirez ..... 83/438
5,779,407 A * 7/1998 Tucker et al. ..... 409/218
5,805,812 A 9/1998 Fish et al.
5,823,239 A * 10/1998 Smith ..... 144/135.2

(Continued)

*Primary Examiner* — Lee D Wilson
*Assistant Examiner* — Jamal Daniel
(74) *Attorney, Agent, or Firm* — James A. Lucas; Driggs, Hogg, Daugherty & Del Zoppo Co., LPA

(57) ABSTRACT

A fence device includes a coordinate system for providing accurate positioning of a workpiece along two perpendicular axes. Precise repeatable positioning of the workpiece relative to a given reference point is achieved. Two or more separate calipers are used for the positioning. The device includes parallel channels along two opposing edges of a table top. Channel guides along edges of a fence engage the channels for movement of the fence toward and away from a cutter bit or other material removing tool. A first caliper determines the distance that a workpiece may be moved when engaging the cutter bit. The location of a workpiece along the fence is determined using a second caliper perpendicular to the first caliper. A slide plate is secured at right angles to the fence and uses the second caliper to accurately position the distance of the fence with relation to the tool.

18 Claims, 7 Drawing Sheets

(56) References Cited

U.S. PATENT DOCUMENTS

| | | | | |
|---|---|---|---|---|
| 5,890,524 | A * | 4/1999 | Tucker et al. | 144/371 |
| 5,927,857 | A * | 7/1999 | Ceroll et al. | 384/42 |
| 5,967,717 | A * | 10/1999 | Tucker et al. | 409/137 |
| 6,061,921 | A * | 5/2000 | Adams et al. | 33/638 |
| 6,148,703 | A * | 11/2000 | Ceroll et al. | 83/13 |
| 6,161,459 | A * | 12/2000 | Ceroll et al. | 83/468 |
| 6,206,060 | B1 * | 3/2001 | Blake | 144/87 |
| 6,250,190 | B1 * | 6/2001 | Ceroll et al. | 83/438 |
| 6,305,449 | B1 * | 10/2001 | Stover | 144/371 |
| 6,357,328 | B1 * | 3/2002 | Ceroll et al. | 83/477.2 |
| 6,460,442 | B2 * | 10/2002 | Talesky et al. | 83/438 |
| 6,499,224 | B1 * | 12/2002 | Asick | 33/628 |
| 6,520,225 | B1 * | 2/2003 | Dembicks | 144/253.5 |
| 6,557,601 | B1 * | 5/2003 | Taylor | 144/253.1 |
| 6,588,468 | B1 * | 7/2003 | Tucker et al. | 144/372 |
| 6,640,683 | B2 * | 11/2003 | Lee | 83/477.2 |
| 6,644,157 | B2 * | 11/2003 | Huang | 83/438 |
| 6,647,847 | B2 * | 11/2003 | Hewitt et al. | 83/446 |
| 6,675,685 | B2 * | 1/2004 | Ceroll et al. | 83/438 |
| 6,725,755 | B1 * | 4/2004 | Svetlik | 83/468 |
| 6,786,122 | B2 * | 9/2004 | Svetlik | 83/468 |
| RE38,612 | E * | 10/2004 | Tucker et al. | 409/218 |
| 6,817,275 | B1 * | 11/2004 | Chin-Chin | 83/435.11 |
| 6,851,345 | B1 * | 2/2005 | Kennelly et al. | 83/438 |
| 6,901,680 | B2 * | 6/2005 | Locaputo | 33/642 |
| 7,059,370 | B2 * | 6/2006 | Wang | 144/287 |
| 7,174,820 | B2 * | 2/2007 | Huang | 83/446 |
| 7,255,144 | B2 * | 8/2007 | Smith | 144/253.6 |
| 7,322,266 | B2 * | 1/2008 | Lin | 83/522.11 |
| 7,497,239 | B2 * | 3/2009 | Smith | 144/286.5 |
| 7,614,330 | B2 * | 11/2009 | Griswold et al. | 83/477.2 |
| 7,930,960 | B2 * | 4/2011 | Duginske | 83/438 |
| 7,997,312 | B2 * | 8/2011 | Van Valkenburg | 144/253.1 |
| 8,312,799 | B2 * | 11/2012 | Frolov | 83/438 |
| 8,424,434 | B2 * | 4/2013 | Koegel et al. | 83/477.2 |
| 8,616,104 | B2 * | 12/2013 | Frolov et al. | 83/471 |
| 8,763,504 | B2 * | 7/2014 | Tardif | 83/441.1 |
| 8,783,240 | B2 * | 7/2014 | Lawlor | 125/35 |
| 8,789,450 | B2 * | 7/2014 | Scherl | 83/446 |
| 2002/0050201 | A1 * | 5/2002 | Lane et al. | 83/477.2 |
| 2002/0078810 | A1 * | 6/2002 | Talesky et al. | 83/438 |
| 2002/0108480 | A1 * | 8/2002 | Hewitt et al. | 83/446 |
| 2002/0134212 | A1 * | 9/2002 | Ceroll et al. | 83/438 |
| 2003/0213349 | A1 * | 11/2003 | Chang | 83/438 |
| 2004/0060411 | A1 * | 4/2004 | Svetlik | 83/522.19 |
| 2004/0065387 | A1 * | 4/2004 | Smith | 144/253.1 |
| 2005/0139056 | A1 * | 6/2005 | Gass et al. | 83/438 |
| 2005/0167000 | A1 * | 8/2005 | Dick | 144/253.1 |
| 2006/0070503 | A1 * | 4/2006 | Shibata et al. | 83/438 |
| 2006/0144203 | A1 * | 7/2006 | Behne et al. | 83/446 |
| 2006/0144470 | A1 * | 7/2006 | Fontaine | 144/286.1 |
| 2007/0125921 | A1 * | 6/2007 | Wisen | 248/288.31 |
| 2008/0053284 | A1 * | 3/2008 | Miller et al. | 83/446 |
| 2008/0236355 | A1 * | 10/2008 | Gass et al. | 83/438 |
| 2008/0257124 | A1 * | 10/2008 | Yu | 83/438 |
| 2009/0277315 | A1 * | 11/2009 | Ipatenco et al. | 83/171 |
| 2010/0071521 | A1 * | 3/2010 | Hadaway et al. | 83/76.1 |
| 2011/0135410 | A1 * | 6/2011 | Wisen | 408/2 |
| 2011/0192497 | A1 * | 8/2011 | Clark | 144/371 |
| 2013/0152754 | A1 * | 6/2013 | Lawlor | 83/435.11 |

* cited by examiner

PRECISION POSITIONING OF A FENCE

CROSS-REFERENCE TO RELATED APPLICATIONS

This application claims the benefits of the provisional patent application previously filed in the United States Patent and Trademark Office by common inventor Dennis R. Wisen entitled PRECISION POSITIONING OF A FENCE, Ser. No. 61/390,777, filed Oct. 7, 2010, Confirmation 6668.

BACKGROUND OF THE INVENTION

1. Field of the Invention

This invention relates generally to the field of woodworking equipment. More particularly, the invention relates to a mounting device to provide accurate positioning along two perpendicular axes and to facilitate precise measurements when performing a material removal operation on a work piece.

2. Discussion of Prior Art

The old adage among carpenters and woodworkers in order to avoid costly and time-consuming mistakes is to "measure twice and cut once". This guideline is normally learned only through the experiences of making many mistakes in the workshop.

Woodworkers are constantly seeking more accurate, reliable and repeatable techniques for sawing, routing, milling, turning, and drilling wood. Particularly, when working with a router for accurately removing a portion of wood, and for precisely repeating the step multiple times, many others have attempted to improvise jigs and complex devices for calibrating and measuring before activating a routing tool.

Particularly challenging is the formation of joints such as dovetail joints which are used to securely join two pieces of wood together in a close-fitting and visually appealing joint. An important requirement for such a joint is that the individual cuts forming the joint are symmetrical about the ends of the two pieces. This symmetry is typically achieved by a careful set-up step commonly referred to as "centering". Attempting to carry out this step manually without the benefit of a positioning jig requires considerable time and dexterity. What is needed is a device and procedure for simply and quickly centering a workpiece.

BRIEF SUMMARY OF THE INVENTION

The present application relates to a device and a method for accurately adjusting a fence used with a tool such as a router mounted on a table having a pair of sides that are generally parallel to one another. An elongated fence is movable toward and away from the router. The fence has a first end and a second end. A pair of parallel channels is provided along the sides of the table. Each channel preferably is recessed below the table top and engages a channel guide at each end of the fence for moving the fence toward and away from the tool. A slide plate is secured at right angles to the fence and is supported along two edges by a plurality of rollers mounted on a slide plate support. The slide plate moves with the fence as the fence is moved toward and away from the tool. The rollers include at least two rollers spaced along one edge of the slide plate and at least one roller that is biased into pressure contact with the other edge of the slide plate. A first caliper is used to measure the distance between the fence and the slide plate support. A second caliper measures the distance between an edge of a workpiece and the tool. The channels and the slide plate permit very precise movement of the fence toward and away from the tool. The calipers are used to determine the distance that the fence is to be moved prior to each tool maneuver.

The invention has multiple uses including a fence for a router or a shaper, a drill press guide, a mortising machine, a table saw, locating components for assembly operations, and for use in inspection equipment. The fence system allows for precise repeatable positioning in relation to the cutter or other reference point. Further, it allows for the changing of cutters or router bits without changing or re-establishing a new reference point in line with the axes of the fence.

The invention may take form in various components and arrangements of components, and in various steps and arrangements of steps. The drawings are only for purposes of illustrating an embodiment of the invention and are not to be construed as limitations thereof. Further aspects of the present invention will be appreciated to those of ordinary skill in the art upon reading and understanding the following detailed description.

DETAILED DESCRIPTION OF THE INVENTION

The invention relates to a device and the use thereof for precisely aligning a fence with respect to a rotating material-removing tool such as a sander, router, or a drill bit or for one of the uses aforesaid. For purposes of illustration only, the drawings show the use of the invention in connection with a router.

Figure 1:
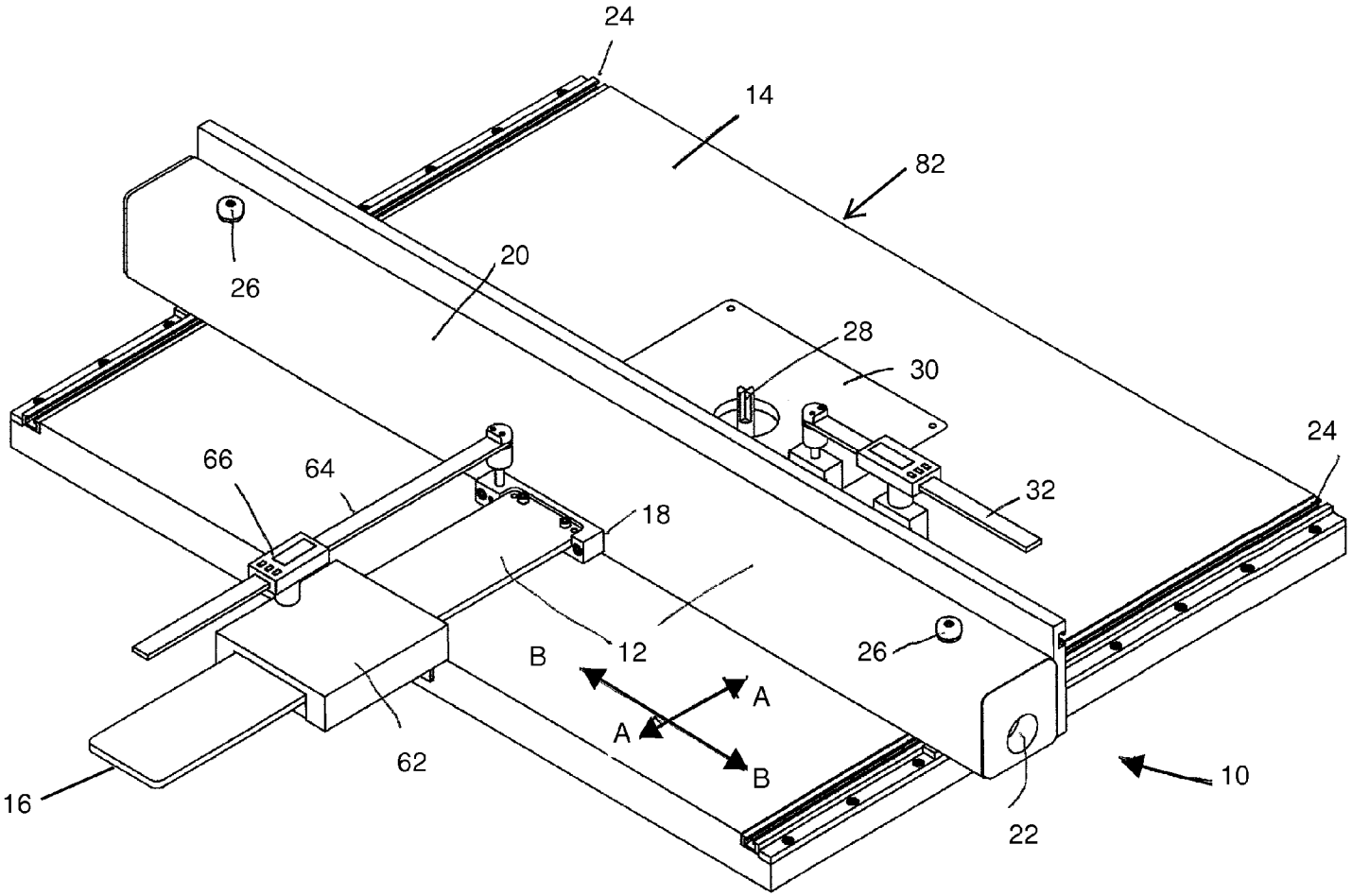
FIG. 1 is a first perspective view of the overall features of the present invention.
Figure 2:
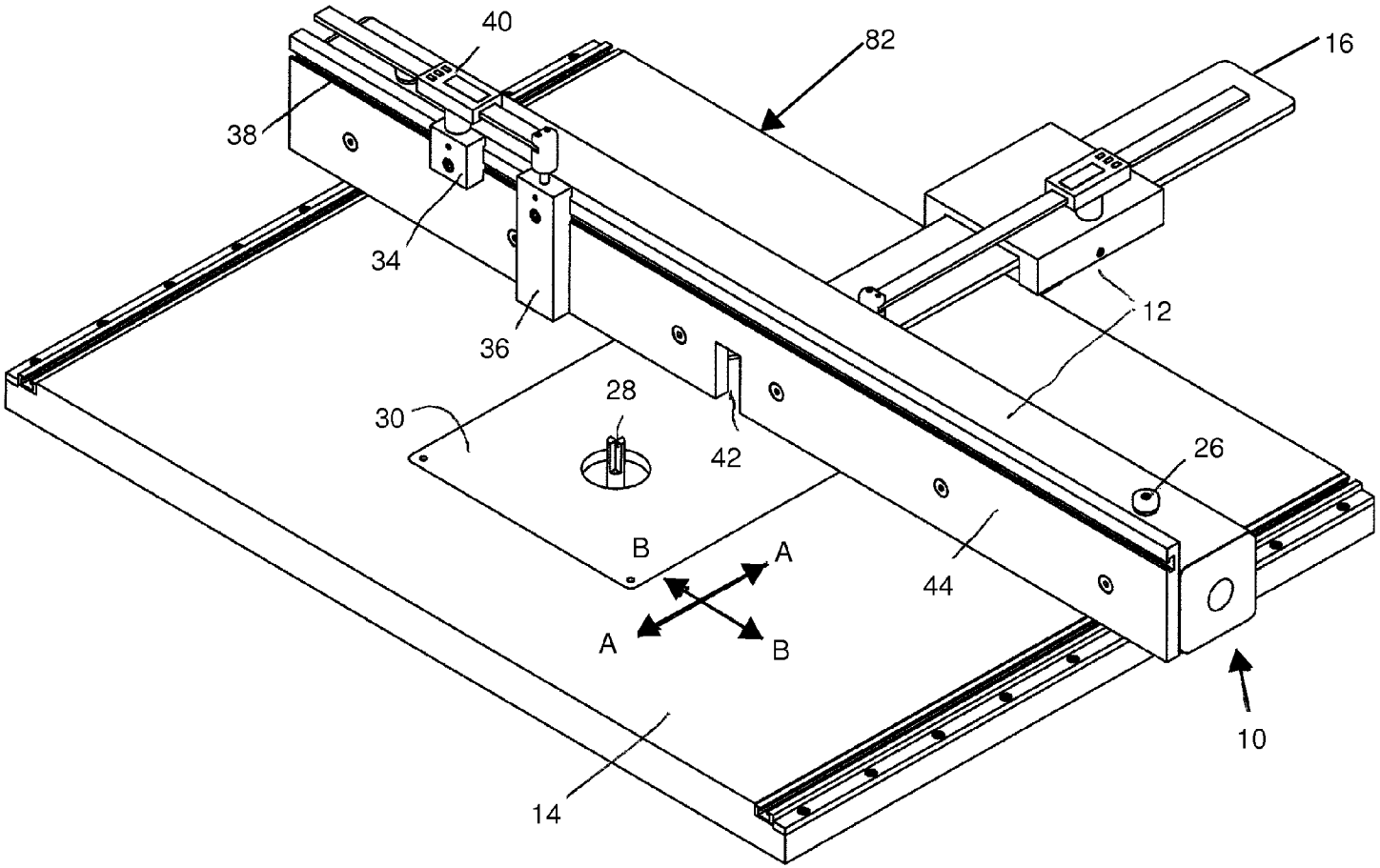
FIG. 2 is a second perspective view of the overall features of the present invention.

Referring in detail to the drawings, FIGS. 1 and 2 give an overall perspective view of the device of the present invention. In these drawings is shown a fence device 10 which includes a coordinate system that allows accurate positioning along two perpendicular axes, A-A and B-B. The device comprises a router fence assembly 12 comprising a table having a top 14 and a slide plate 16 anchored in a receiver 18 to a fence 20. The slide plate 16 is parallel to the table top 14, includes two parallel edges, and is perpendicular to the fence 20. The fence 20 is elongated, preferably tubular, and may be provided with an outlet 22 at one end to which a suitable suction system such as a vacuum (not shown) may be connected. Each end of the fence is adapted to ride in a channel 24 mounted to the table below the table top 14 so as to not obstruct movement of the fence. The ends of the fence are adapted to be secured to the two channels by a pair of bolts (shown in detail in FIG. 5) and clamp nuts 26 or other attaching devices such as wing nuts. This provides maximum support and minimum deflection of the fence during adjustments and use.

A cutter bit 28 extends through a router base plate 30 that is mounted flush with the table top 14. A pair of calipers 32, 64 are used to provide accurate positioning of the fence 20 and a fence stop 36 with respect to a router bit 28. The free end of a first caliper 32 is slidably mounted through a bracket 34 (shown in FIG. 2) to a channel 38 extending across the face 44 of the fence 20 parallel to the table top 14 by suitable fastening means such as an Allen head screw or a nut and bolt. The fixed end of the caliper is secured to a fence stop 36 engaging a channel 38 for movement parallel to the table top 14 toward and away from the cutter bit 28. A digital or analog readout 40 is mounted to the bracket 34. The fence 20 is provided with a cut-out portion 42 along the face 44 to provide clearance for the router bit 28 as the fence is moved toward the bit during adjustment.

Figure 3:
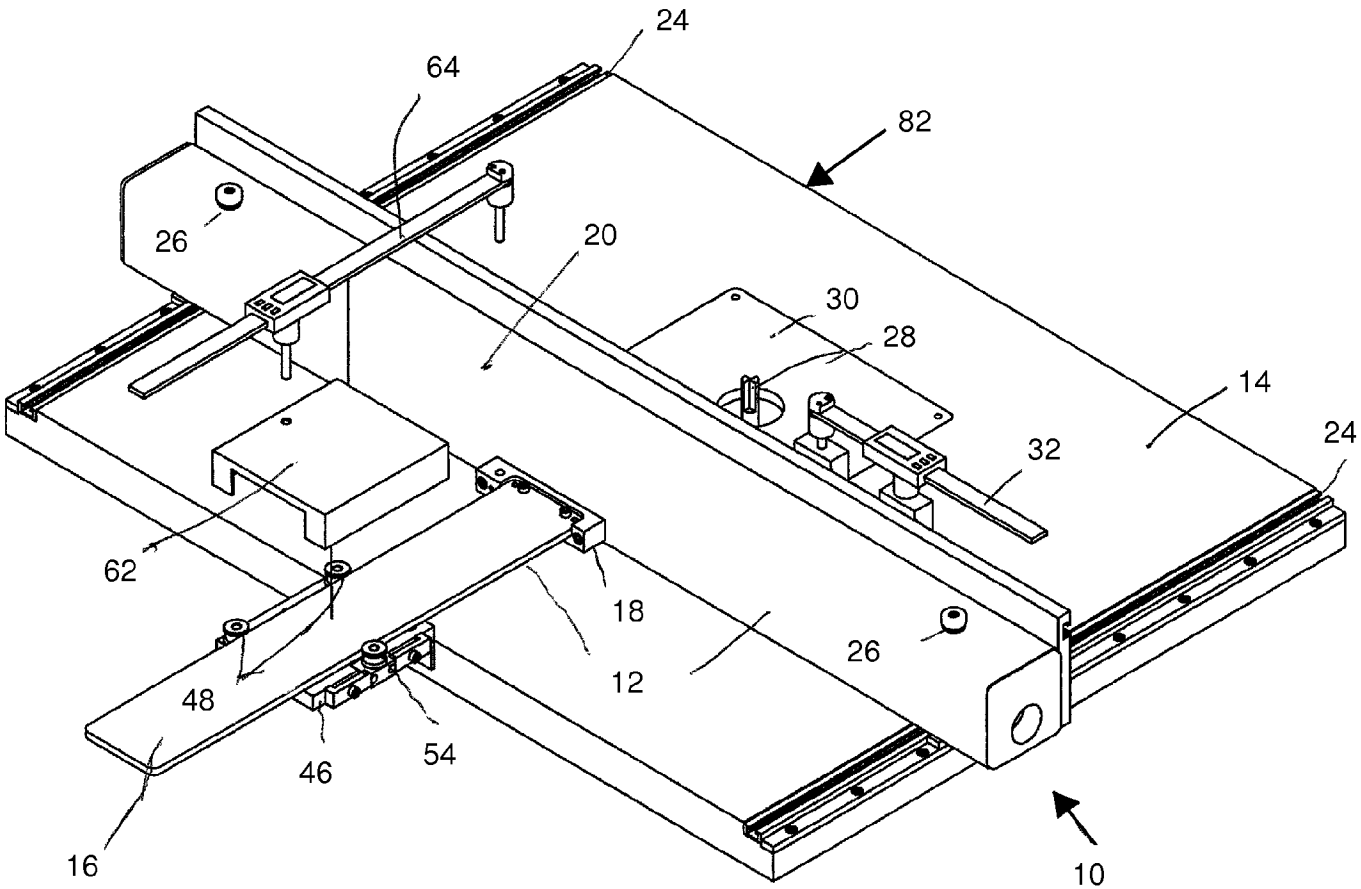
FIG. 3 is a partially exploded perspective view showing details of the slide plate guide mechanism.
Figure 4:
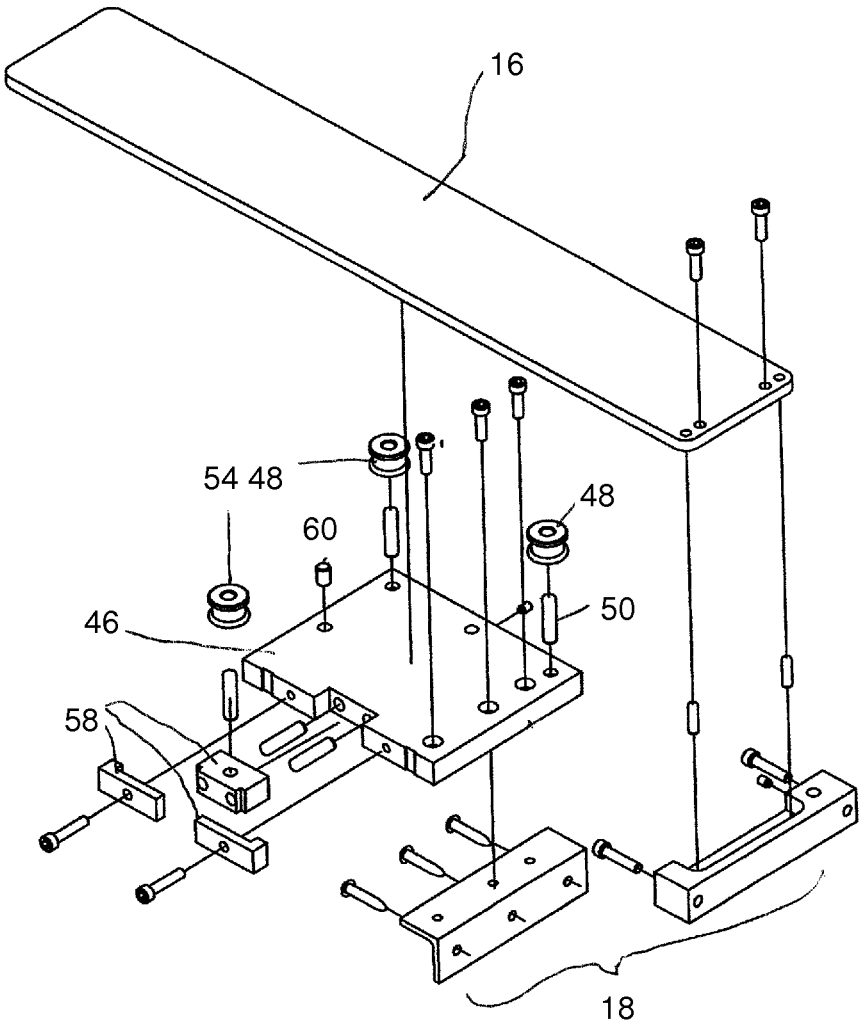
FIG. 4 is a fully exploded perspective view of the slide plate guide.

Turning now to FIGS. 3 and 4, the slide plate mechanism is shown in greater detail. As previously noted, the slide plate 16 is anchored to the fence 20 through a receiver 18. A roller base 46 contains a pair of grooved rollers 48 riding on dowel pins 50 and engaging one side of the slide plate 16. A single grooved roller 54 is mounted on the roller base 46 in pressure contact with the opposite side of the slide plate 16. The slide plate 16 is secured to the roller base 46 with pressure bars 58 screwed into the roller base. These pressure bars 58 serve to apply proper pressure onto the slide plate thereby allowing low friction linear movement of the slide plate while insuring linear integrity during adjustment and clamping of the fence 20. The pressure for this purpose is sufficient to permit the slide plate to be moved linearly without binding or deflection and without lateral movement between the rollers. A standoff pin 60 made from a material such as Delrin® may be mounted in the face of the roller base to cooperate with the receiver 18 to maintain the slide plate parallel with the top 14 of the table.

A cover 62 serves to protect the rollers from wood chips, saw dust and other contaminants. A caliper 64 has one end attached to the receiver 18 and slides through a digital or analog readout device 66 mounted to the cover. This caliper 64 is used to determine the precise spacing between the face 44 of the fence 20 and the router bit 28 or other material removing tool.

Figure 5:
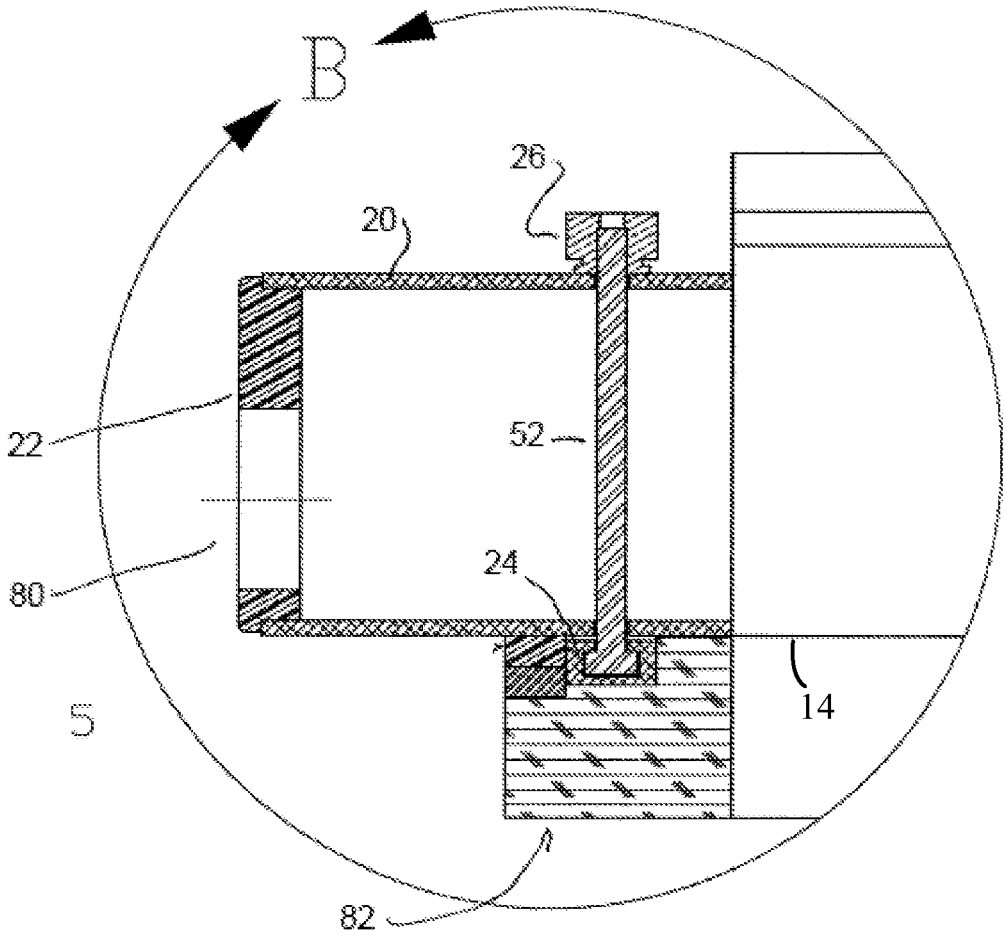
FIG. 5 is a cross sectional view showing one end of the fence clamped in place.

An enlarged cross sectional view of one end of the fence is shown in FIG. 5. The end of the fence 20 is provided with an end cap 22 having a hole to which can be attached a suitable suction system such as a vacuum cleaner hose (not shown). The table 82 includes a channel 24 recessed below the surface of the table top 14. A guide bolt 52 extends through the fence with the head of the bolt engaging the channel 24. The fence is locked in place by turning the clamp nut 26 at each end of the fence 20 to secure each bolt in the respective channel 26.

Figure 6B:
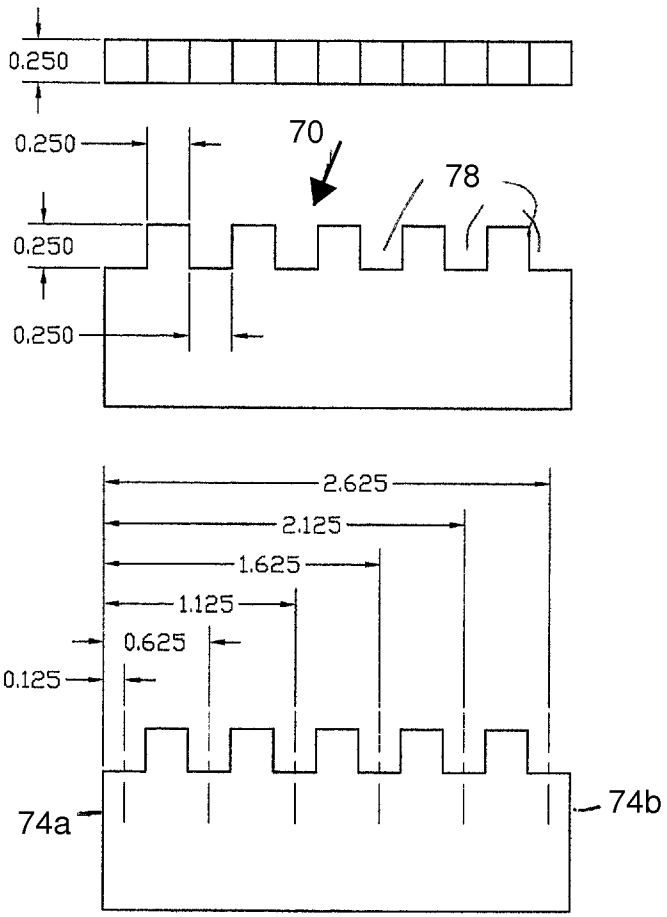
FIG. 6 shows a typical template for setting the position of the fence on a router table.
Figure 6A:
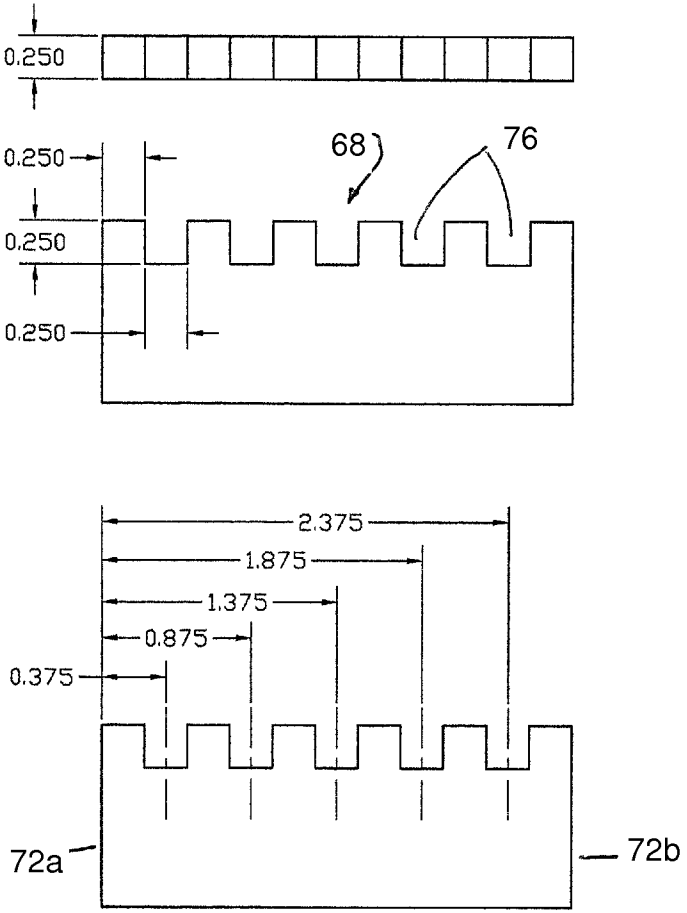

To further understand the present invention, a template is illustrated in FIG. 6 for use to prepare a box joint between two pieces of wood. As a preliminary step, the template may be prepared manually or by use of a suitable software program. The template depicts two pieces of wood labeled as 68 and 70. The two ends (72*a*, 72*b*) of wood piece 68 and the corresponding two ends (74*a*, 74*b*) of piece 70 that are intended to be joined are shown on the template. The width and depth of the slots in each piece are shown, including the distance of each slot from an edge of the piece. Each slot and its corresponding tooth are ¼" by ¼". The slots in each piece are offset from one another by the width of the first slot so that when the pieces are joined, the two edges 72*a*, 74*a* and 72*b*, 74*b* of the pieces are co-planar.

Figure 7:
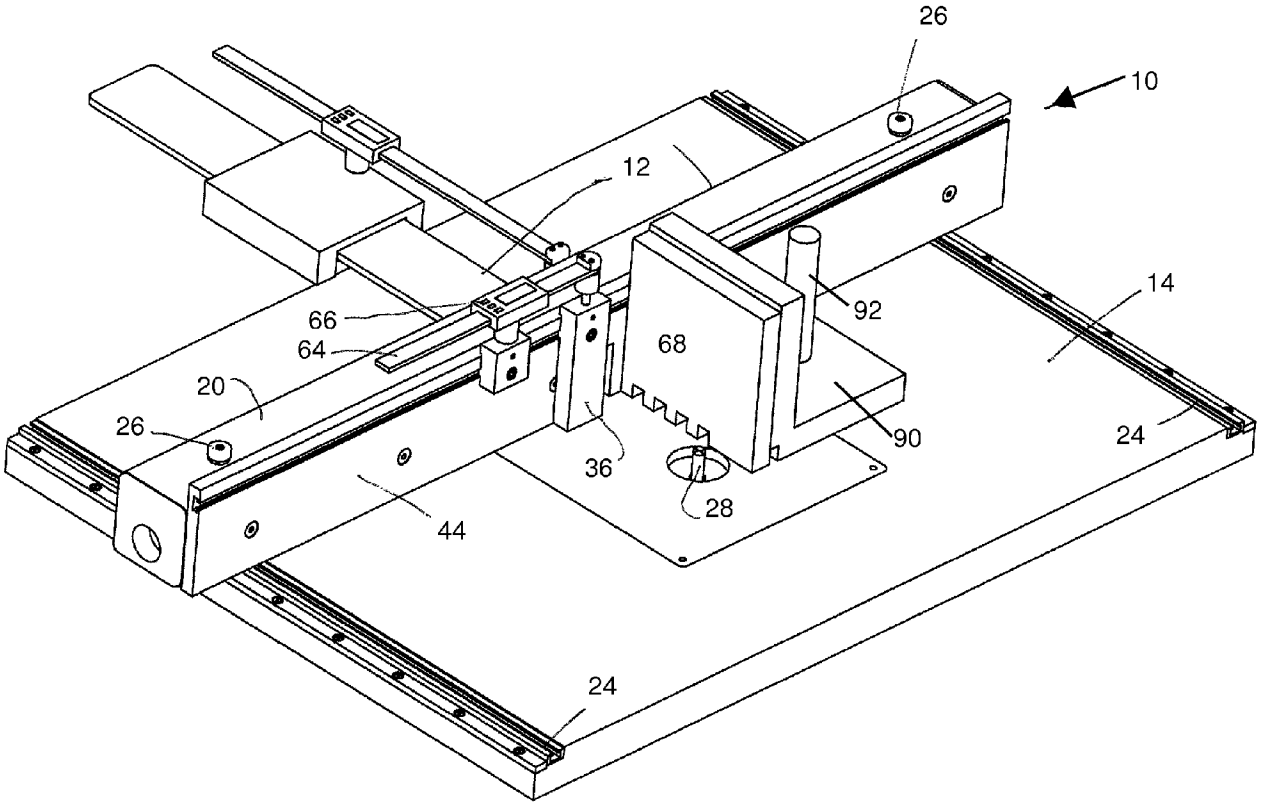
FIG. 7 provides a perspective view of a wood panel in position prior to engagement with a router bit.

Referring next to FIG. 7, the fence 20 is positioned on the table top 14 whereby the fence face 44 is directly over the center of the router bit 28. Using the first caliper 32, the fence stop 36 is set at a distance from the center of the bit 28 at least equal to the thickness of the wood. The height of the bit above the table top 14 is set at ¼", equal to the intended depth of each slot. The readout 66 on caliper 64 is then set to zero. The fence 20 is moved away from the router bit 28 a distance equal to one-half of the thickness of the router bit 28 plus one half of the thickness of each joint. The fence 20 is then secured to the channels 24 in the table top 14 by tightening the clamp nuts 26. The router bit 28 is set to extend vertically above the top of the table top 14 a distance equal to the depth of the cut to be made in the piece of wood 68.

After the first slot is routed out, the fence is moved for the second cut by loosening the clamp nuts 26 and sliding the fence from the router a distance of ½" as measured on the caliper readout 66. The fence is then tightened down and the second cut is made. This process is repeated for each cut across the width of piece 68. The process is repeated on the second piece 70, offsetting the cuts by the thickness of one slot to maintain edge alignment of the two pieces.

While the invention has been described in combination with embodiments thereof, it is evident that many alternatives, modifications, and variations will be apparent to those skilled in the art in light of the foregoing teachings. Accordingly, the invention is intended to embrace all such alternatives, modifications and variations as fall within the spirit and scope of the appended claims.

What is claimed is:

1. A table for use with a material removing tool, said tool mounted in a fixed position with respect to said table, said table having a table top, and a pair of channels that are parallel to one another;

an elongated fence movable on said table top toward and away from the tool and having a first end and a second end;

a channel guide at each end of the fence engaging one of the parallel channels for moving the fence toward and away from the tool and for securing the fence to the table top;

the improvement comprising a slide plate secured at right angles to the fence and parallel to the table top, and supported by rollers mounted on a roller base for moving the fence toward and away from the material removing tool;

the rollers comprising at least two rollers spaced from one another along one edge of the slide plate and at least one roller that is biased into pressure contact with the other edge of the slide plate; and a first caliper for measuring the distance between an edge of a workpiece and the material-removing tool.

2. The table according to claim 1 wherein the tool is a router and the fence has an opening to receive a router bit.

3. The table according to claim 1 wherein the fence is tubular and is adapted to be connected to a vacuum source.

4. The table according to claim 1 wherein the slide plate is parallel to, and spaced from the top of the table by a standoff pin to maintain linearity between the slide plate and the fence.

5. The table according to claim 1 further including a protective cover over the slide plate.

6. The table according to claim 4 including a second caliper having one end attached to the roller base and another end attached to the fence.

7. The table according to claim 1 wherein the rollers are grooved and the slide plate includes two edges which engage the roller grooves.

8. The table according to claim 1 wherein the fence includes a fence stop, said first caliper slidably engages a channel extending along the length of the fence for movement toward and away from the material-removing tool for measuring the distance between the tool and said fence stop.

9. A method for accurately adjusting a fence used with a tool mounted on a table having a top and a pair of channels that are generally parallel to one another, and an elongated fence movable toward and away from the tool, said fence having a first end and a second end;

the improvement comprising extending said pair of channels along two sides of the table;

engaging a channel guide at each end of the fence for moving the fence toward and away from the tool and for locking the fence in place;

providing a slide plate parallel to the table top, secured to the fence, and having a pair of parallel edges extending from the fence at right angles thereto, supporting said slide plate between rollers mounted on a slide plate support for moving the fence toward and away from the tool;

spacing at least two of the rollers apart from one another along one edge of the slide plate biasing at least a third roller into pressure contact with the other edge of the slide plate; and utilizing a first caliper for measuring the distance between an edge of a workpiece and said tool.

10. The method according to claim 9 further including spacing the slide plate from the top of the table by a standoff pin to maintain linearity between the fence and the slide plate.

11. The method according to claim 9 further including providing a fence stop engaging a slot extending along the elongated fence, and a second caliper for measuring the distance between the fence and the tool.

12. The method according to claim 11 further including attaching one end of the first caliper to the roller base and attaching the other end to the fence.

13. The method according to claim 9 including providing grooves in the rollers, and engaging the slide plate with said grooves.

14. A device mounted on a woodworking tool comprising a table with a table top, and a fence, said device comprising a roller base including a slide plate having one end secured to said fence, said slide plate extending parallel to the table top and at right angles to the fence, a roller base secured to the table to receive the slide plate and carrying rollers through which two parallel edges of the slide plate roll, a pair of said rollers positioned apart from one another along one of the parallel edges of the slide plate, and at least one other roller positioned along the other of the parallel edges of the slide plate and held against said other edge by a pressure plate.

15. The roller base according to claim 14 wherein the rollers contain circumferential grooves to receive the two parallel edges of the slide plate.

16. The roller base according to claim 14 further including at least one standoff pin on the roller base to maintain a spaced planar relationship between said table top, and the slide plate, said planar relationship corresponding to the distance that the slide plate is spaced from the table top.

17. The roller base of claim 16 including a first caliper anchored in a fence channel parallel to said table top and slidably movable toward and away from said woodworking tool.

18. The roller base of claim 16 including a second caliper having one end attached to said slide plate to enable accurate determination of the spacing between the fence and said woodworking tool.

* * * * *